US005144328A

United States Patent [19]

Blake et al.

[11] Patent Number: 5,144,328

[45] Date of Patent: Sep. 1, 1992

[54] METHOD FOR PRODUCING AN IMAGE ON A SUBSTRATE HAVING THE SAME SPECTRAL CONTENT WITH FRONT AND BACK ILLUMINATION

[75] Inventors: Dale Blake, Wooster, Ohio; Donald Redding, Pasadena, Calif.

[73] Assignee: Metromedia Company, Secaucus, N.J.

[21] Appl. No.: 540,892

[22] Filed: Jun. 20, 1990

[51] Int. Cl.[5] ..... B41J 2/005; B41J 29/19

[52] U.S. Cl. ..... 346/1.1; 40/443; 346/17

[58] Field of Search ..... 346/1.1, 135.1, 134, 346/140 R, 17; 400/188; 40/442, 443, 615, 219, 584, 624; 427/209, 210

[56] References Cited

U.S. PATENT DOCUMENTS

| | | | |
|---|---|---|---|
| 3,163,554 | 12/1964 | Gessler | 40/443 |
| 4,547,786 | 10/1985 | Logan et al. | 346/140 R |
| 4,666,757 | 5/1987 | Helinski | 346/135.1 |
| 4,811,038 | 3/1989 | Gordon et al. | 346/140 R |
| 4,889,761 | 12/1989 | Titterington et al. | 346/1.1 |

*Primary Examiner*—Benjamin R. Fuller

*Assistant Examiner*—Alrick Bobb

*Attorney, Agent, or Firm*—McCormick, Paulding & Huber

[57] ABSTRACT

A method for producing a large scale color graphic that presents substantially the same spectral content to a viewer when the graphic is illuminated with front or back lighting includes applying an ink film on a first surface and a second ink film on a second surface wherein the ink film creates the desired colored graphic image and which images produced are in registry with one another. A light source located on the same side as an observer viewing the image passes light through the ink film in one direction and is reflected back through the ink in a substantially opposite direction so that light reaching the observer passes through the equivalent of two ink film thicknesses. A light source located in back of the image so that the image is between the light source and an observer passes light through the first and second ink film layers in a direction toward the observer so that the observer views light having a spectral content that passes through the equivalent of two ink film thicknesses and replicates the spectral content of light from a light source located on the same side as the observer.

11 Claims, 2 Drawing Sheets

METHOD FOR PRODUCING AN IMAGE ON A SUBSTRATE HAVING THE SAME SPECTRAL CONTENT WITH FRONT AND BACK ILLUMINATION

BACKGROUND OF THE INVENTION

The present invention relates generally to ink jet printing systems for large scale graphic generation and deals more particularly with a method for producing a large scale color graphic that presents substantially the same spectral content to a viewer when the graphic is illuminated with front or back lighting.

Large scale color graphic systems for producing images on sheet material or other substrates for use in outdoor advertising, road side billboards and signs and displays in railway or airport terminals, shopping malls and other such public areas are disclosed in U.S. Pat. No. 4,547,786 entitled "INK JET PRINTING SYSTEM" and U.S. Pat. No. 4,811,038 entitled "INK JET PRINTING SYSTEM AND DRUM THEREFORE" both of which are assigned to the same assignee as the present invention and the disclosures of which are incorporated herein by reference.

The large scale color graphic systems, such as those referenced above, produce images using four color process pigment inks on an opaque white substrate. The images are generally optimized for outdoor viewing in natural light by day and may be illuminated from the front by artificial lighting means for viewing at night. Although there is a difference in the spectral content of the viewed image under natural and artificial illumination, the lighting is sufficiently similar to cause the image produced with the four color process pigmented inks to appear substantially the same under either natural or artificial illumination. Additionally, the contrast of the image, that is, the ratio of the light reflected from the lightest area on the image to the light reflected from the darkest area on the image, remains substantially constant regardless of the illumination type.

In order to achieve a more dramatic nighttime effect, images are produced which are intended for backlight viewing, that is, the light source is located such that the image is located between the light source and a viewer. Generally, these images are produced using four color process pigmented inks deposited on a translucent white substrate. The substrate carrying the image is suspended on a frame or other such apparatus and is illuminated with a light source located at the rear, that is, on the opposite side of the substrate carrying the image.

A general problem associated with images produced on a substrate intended for backlighting is that the image must generally be produced with more highly pigmented inks or thicker ink films than those images produced on substrates intended for lighting by front illumination. When such images are illuminated by backlight at night, the image is of generally good quality however, during daytime viewing, the same image generally appears very dark and the colors may not be true, that is, not having the same spectral content when viewed by a viewer under the different lighting conditions.

It is therefore a general aim of the present invention to substantially overcome the problems associated with images produced on a substrate and which have different spectral content when illuminated by backlighting and front lighting.

SUMMARY OF THE INVENTION

In accordance with the present invention, a method for producing an image with four color process ink on a substrate surface whereby the image exhibits substantially the same spectral content when illuminated by a light source located in front of the surface carrying the image and when illuminated by a light source located behind the surface carrying the image is presented. One or more of differently pigmented inks are applied or printed onto a surface of a substrate, such as a vinyl flexible sheet which is preferably translucent, to create the desired colored graphic. In one aspect of the invention, a second image is created and applied on the opposite surface of the substrate such that the ink film forming the second image is in registry with the ink film forming the first image. When the image is viewed under frontal lighting conditions, light from a light source passes through the ink film forming the first image to the substrate and is substantially completely reflected by the substrate surface back through the ink film and toward a viewer. The viewer observes an image illuminated by light that has passed through the ink film an equivalent of two film thicknesses. When the image is illuminated with a backlight, the light from the light source passes through the ink film of the second image, on through the substrate, and through the ink film forming the first image toward a viewer. Again, the viewer observes an image illuminated with light that has passed through two film thicknesses. Accordingly, both front and rear lighting illuminate an image that is observed by a viewer wherein the color content of the light illuminating the image is absorbed and passed by the equivalent of two ink thicknesses with either lighting type and therefore light reaching the viewer has substantially the same spectral content under either lighting type.

In another aspect of the invention, the second image is created on a surface of a second substrate and both substrates are then laminated such that both images are in registry and alignment with one another. Frontal light passes through the first ink film and is reflected by the surface of the first substrate back toward a viewer such that the viewer observes an image that is illuminated with light which is passed through two ink film thickness. When the image is viewed with backlighting, light passes through the second substrate, which is preferably transparent, through the second ink film and through the first substrate, which is preferably translucent, and through the first ink film in a direction toward a viewer. The viewer observes an image wherein light passes through two ink film thicknesses and has the same spectral content when illuminated by front lighting or backlighting.

BRIEF DESCRIPTION OF THE DRAWINGS

Other features and advantages of the present invention will become readily apparent from the following written description and drawings wherein.

DETAILED DESCRIPTION OF PREFERRED EMBODIMENTS

Figure 1:
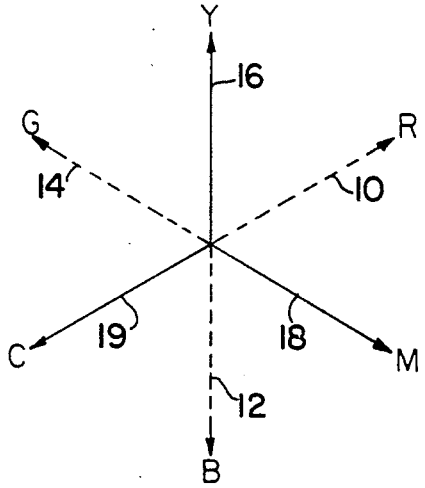
FIG. 1 is a vector diagram illustrating cyan, magenta and yellow color components to explain four color process principles.

Prior to describing the method of the present invention in detail, it is beneficial to have a working knowledge of the four color process system for generating color images of the type with which are of concern to the present invention. Turning first to FIG. 1, a vector diagram is illustrated therein wherein red, blue and green vectors, designated 10, 12 and 14, respectively and vectors 16, 18 and 19 represent the colors yellow, magenta and cyan, respectively. As known, the red, green and blue vectors represent primary colors and if combined in roughly equal proportions, that is, each vector is substantially the same magnitude, the resultant combination is representative of white light. It can also be seen that if one or more of the red, green, blue vectors have unequal magnitudes with respect to one another, the resulting combination will produce a colored light. The resultant color of any combination of the red, green and blue vectors is determined by the addition of the respective vectors. For example, if the blue vector 12 is removed from white light, only the red and green vectors 10,14 respectively remain and the vector sum of the red and green vectors produce the color yellow shown by the vector 16. If the vector 14, representative of green light, is reduced in magnitude, the resultant vector will shift clockwise toward the red vector and the resultant color may be seen as orange. Similarly, if the red vector 10 is removed from white light the remaining blue and green vectors 12,14 respectively will produce the color cyan shown by the vector 19. Likewise, if the color green shown as the vector 14 is removed from white light, the remaining red and blue vectors add to produce the color magenta shown by the vector 18.

The foregoing provides the fundamentals for understanding a four color process using transparent substractive pigmented inks to produce a colored graphic image. For purposes of explanation it is assumed that the various pigmented inks used are ideal. A perfect process yellow ink passes red and green light unattenuated and totally absorbs blue light. Likewise, an ideal perfect process magenta ink is transparent to red and blue light but absorbs green light and an ideal process cyan ink is transparent to blue and green light but absorbs red light. Colored graphic images generated with pigmented inks such as the graphic generation disclosed in the above-identified patents, result in multi-layer ink films and produce accumulative effects. For example, in a two-layer ink film comprised of yellow and magenta process inks, both blue and green light are absorbed and the resultant color is red. In the case of a three-layer ink film of yellow, magenta and cyan, all of the red, green and blue light is absorbed and the resultant color produced is black. For further details of four color process systems and techniques, the reader may refer to numerous textbooks and literature available in the art.

Figure 2:
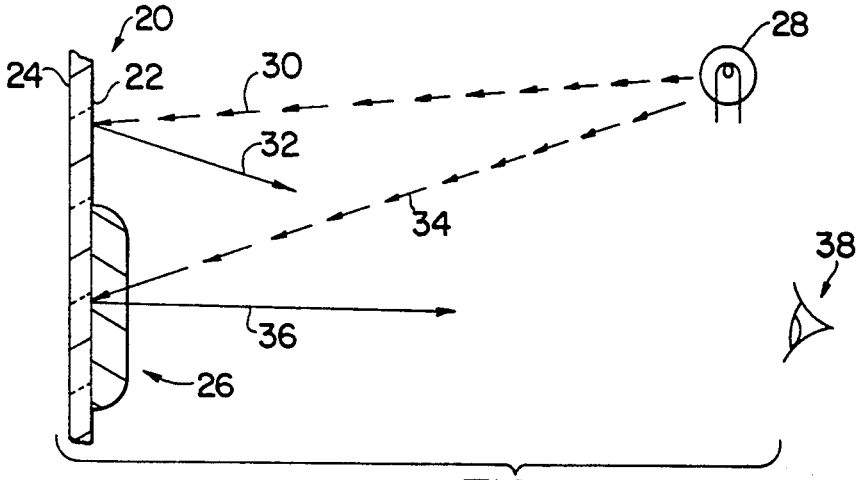
FIG. 2 PRIOR ART
FIG. 2 shows an ink film on a substrate with front lighting in the prior art.
Figure 3:
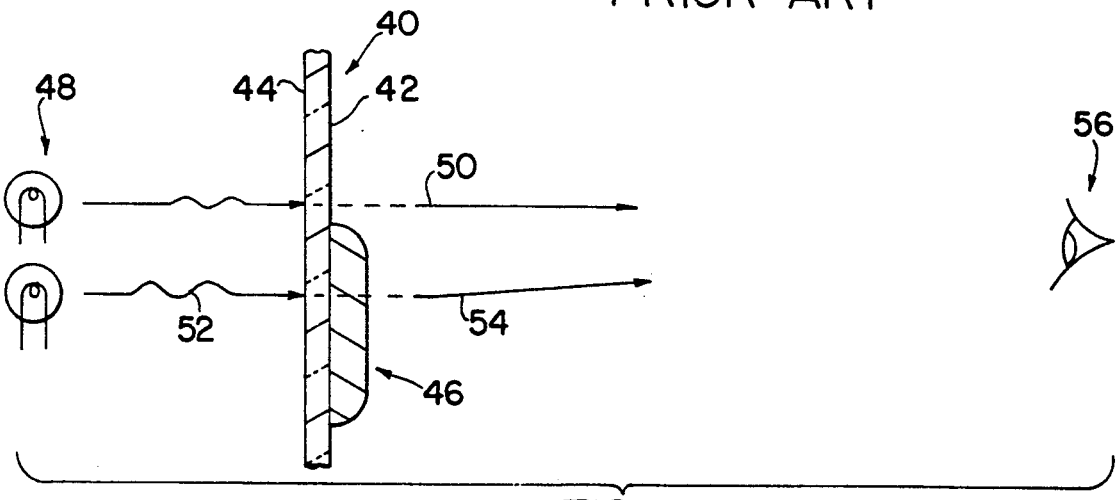
FIG. 3 PRIOR ART
FIG. 3 shows an ink film on a substrate with backlighting in the prior art.

Turning to FIGS. 2 and 3, FIG. 2 shows an ink film on a substrate with front lighting in the prior art and FIG. 3 shows an ink film on a substrate with backlighting in the prior art. In FIG. 2, an opaque white substrate generally designated 20 has a front surface 22 and rear surface 24 and upon which an ink film generally designated 26 is applied to the surface 22. The ink film 26, for purposes of explanation, is considered to be a yellow pigmented ink. The pigmentation of the yellow ink film 26 is such that 50% of the blue light is removed or absorbed in a single passage of light through the film. A light source generally designated 28 is assumed to emit white light, which recalling from above, comprises the vector addition of equal magnitude red, green and blue vectors and which white light is shown as the ray 30. The white light ray 30 impinges on the surface 22 of the substrate 20 and is reflected as white light represented by the reflected ray 32. White light emitted from the light source 28 and designated by the ray 34 passes through the yellow ink film 26 and impinges on the surface 22 of the substrate 20 and is reflected back through the film 26 as reflected ray 36. The yellow ink film absorbs 50% of the blue component comprising the white light ray 34 in one passage through the film toward the substrate surface 22 and passes 100% of the red and green components of the white light. The impinging resultant light is reflected from the substrate surface 22 back through the yellow ink film 26 as reflective ray 36 which comprises 100% of the red and green components and 50% of the blue component reflected from substrate surface 22, that is, the blue component is again reduced by ½. An observer indicated generally at 38, views the color of the reflected ray 36 produced by 100% of the red and green components of the original white light and 25% of the blue component of the original white light. The ink film will appear to the observer 38 as a modestly dense yellow color.

Turning to FIG. 3, an example of a backlit image in the prior art is illustrated wherein the substrate generally designated 40 is preferably a translucent white substrate and includes a front surface 42 and rear surface 44. As in the case of the front light example illustrated in FIG. 2, the ink film is assumed to be a yellow pigmented ink and is generally designated 46 and is applied to the surface 42 of the substrate 40. A white light source generally designated 48 is located behind the substrate 40, that is, on the same side as the rear surface 44 of the substrate 40. For purposes of comparison to the front light example shown in FIG. 2, the intensity of the white light emitted from the light source 48 is made so that the light represented by the ray 50 passing through the substrate 40 is equal in intensity to the white light ray 32 of FIG. 2. This condition is imposed only for purposes of comparison to the example illustrated in FIG. 2 however, it is not necessary since the light passing through the ink film 46 and the substrate 40 is judged only with reference to the light passing through the substrate alone. The light emitted from the light source 48 and designated by the ray 52 passes through the substrate 40 and the ink film 46 and emerges as the ray 54. Since the light passes through the ink film 46 only once, the blue component of the white light has a 50% absorption and the light reaching an observer generally designated 56, is comprised of 100% of the red and green components and 50% of the blue component so that the yellow ink film appears to the observer 56 as a pale yellow color.

In order to make the ink film 46 of FIG. 3 look similar to the color of the ink film 26 in FIG. 2, the thickness of the ink film in FIG. 3 is doubled as is currently done in the prior art. Since the blue light loss is 50% for each thickness, the resultant would be light made of 100% of the red and green components and 25% of the blue component thereby appearing as the same color to the respective observers in FIGS. 2 and 3 when viewed in front and back light, respectively. However, if the substrate and ink film image of FIG. 3 is viewed with a front light source as in the case of FIG. 2, the light passing through the double thickness ink film in reality makes four passages through the ink film and the resultant reflected light seen by the observer is comprised of 100% of the red and green components and 6.25% of the blue component. Thus it can be seen that the spectral content of the light reaching a viewer is not the same for both type lighting for each of the images produced in the prior art.

It will be appreciated by those skilled in the art that the above analysis may be extended to ink films of any color or in combinations of any such ink films. The analysis is however, complicated in that the available pigmented inks are not perfect and ideal as assumed in the analysis in FIGS. 2 and 3. Nonlinearities in apparent color contamination with film thickness may cause the color of an ink film to be different whether viewed in front or rear light and accordingly, such images produced with conventional known methods do not appear the same to an observer when the image is illuminated with both front and back light even when produced according to the prior art.

Figure 4:
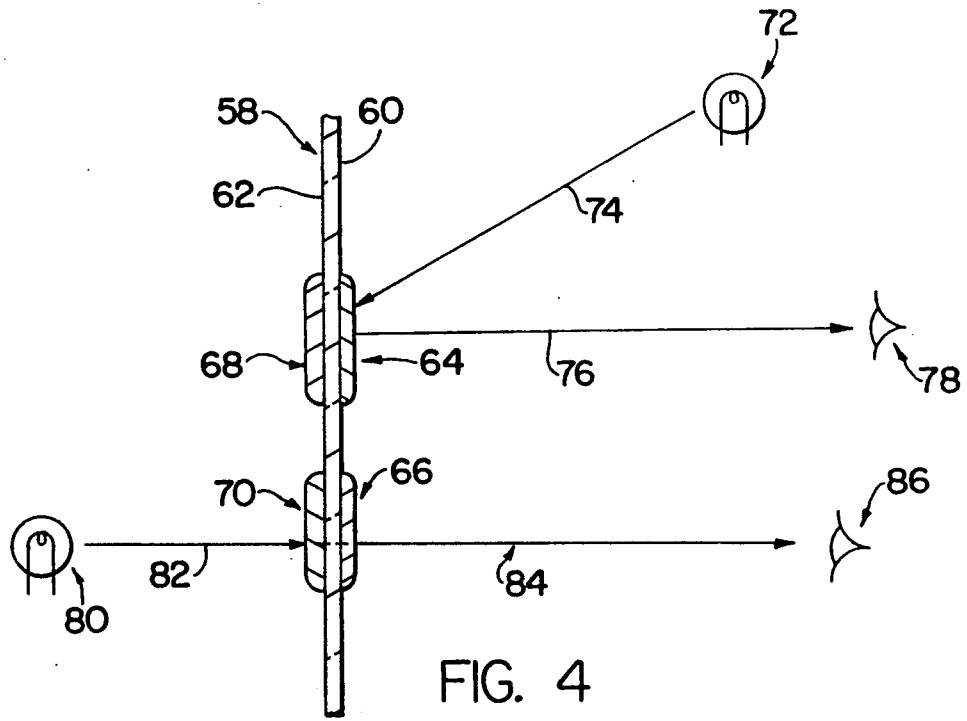
FIG. 4 illustrates one embodiment of the method of the present invention wherein a substrate has an ink film on both front and rear surfaces of the substrate.

Now considering the invention in further detail, reference is made to FIG. 4 wherein a substrate, generally designated 58, includes a front surface 60 and rear surface 62. An image comprised of ink films generally designated as 64 and 66 respectively are applied side-by-side to one surface 60 of the substrate 58. A substantially identical image comprising ink films 68 and 70 respectively are applied to the rear surface 62 of the substrate 58 and in registry with the image applied to the front surface 60. That is, the ink film 68 is in registry with the ink film 64 and the ink film 70 is in registry with the ink film 66. It will be seen that the respective images are mirror images of one another.

A light source generally designated 72 provides front illumination and transmits a ray of white light generally designated 74 toward the substrate 58. The ray 74 passes through the ink film 64 and is reflected by the surface 60 of the substrate 58 back through the ink film 64 as ray 76 toward an observer generally designated 78. The observer sees an image having a spectral content that is the result of light passing through the equivalent of two ink film thicknesses. When the image is illuminated with a backlight generally designated 80, white light emitted as the ray 82 passes through the ink film 70, through the substrate 58 and through the ink film 66 and emerges as the ray 84 in a direction toward an observer generally designated 86. The observer 86 sees a image having a spectral content produced by white light passing through two ink film thicknesses. It can be seen that the observer 78 and observer 86 view an image having substantially the same spectral content whether the image is illuminated by the front light source 72 or the rear light source 80.

In practice, it is preferable that the translucent substrate 58 have an approximate 15% transmission factor resulting in approximately 85% reflectance of light impinging on the substrate surface. It is also found that since imperfect pigmented inks are used and applied to a substrate which is only semi-opaque, and further that the spectral content of the front and back light sources may differ, the optimum reproduction between front and back light conditions may require that the density and color balance of the image applied to the rear surface 62 of the substrate 58 be somewhat different than the density and color balance of the image applied to the front surface 60 of the substrate 58. For example, it may not be necessary to use black pigmented ink on one of the front surface 60 or rear surface 62 which is due in part to the fact that black pigmented ink is nearly opaque and therefore there is no requirement to apply the black pigmented ink to both the front and rear surfaces since all light is substantially absorbed by one thickness.

Figure 5:
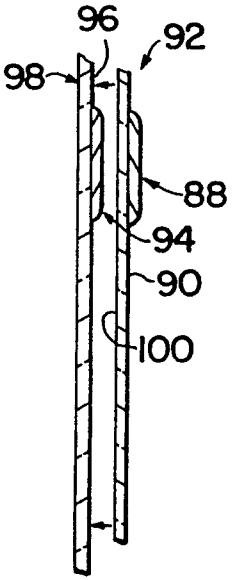
FIG. 5 illustrates another embodiment of the method of the present invention wherein each of two substrates carry an ink film forming the image and are laminated such that the images are in registry.

Turning now to FIG. 5, another embodiment of the method of the present invention is illustrated therein wherein the image to be viewed is created by depositing ink film generally designated 88 on the surface 90 of a substrate generally designated 92. A second image is created by depositing an ink film generally designated 94 on the front surface 96 of a second substrate generally designated 98. The images carried by the substrates 92 and 98 respectively are located in registry and the substrate 92 and 98 are laminated such that the front surface 96 of the substrate 98 is facing the rear surface 100 of the substrate 92. Preferably, the substrate 92 has a 15% transmission factor and the substrate 96 is preferably transparent. It will be seen that when the substrates are laminated with the ink films and accordingly the images in registry, light originating from a front light source passes through the ink film 88 and is reflected from the surface 90 so that the light passes through two ink film thicknesses. Likewise, light emitted from a backlight passes through the substrate 96, ink film 94, substrate 92 and ink film 88 so that light again passes through two ink film thicknesses. Accordingly, it is seen from FIG. 5 that the method of the present invention provides an image viewed by an observer wherein light reaching the observer has substantially the same spectral content regardless of the image being illuminated by a front light or a back light source.

Figure 6:
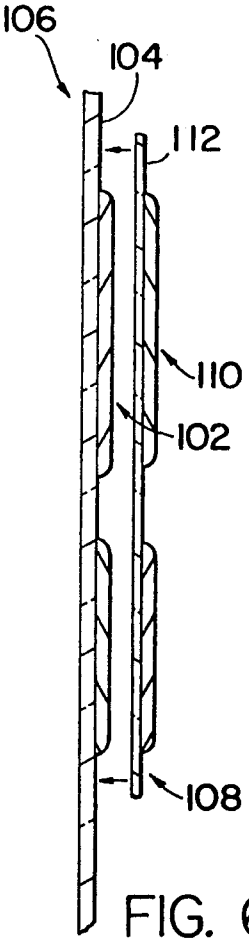
FIG. 6 illustrates another embodiment of the method of the present invention wherein a first ink film image is carried on the substrate surface and is overpainted by a layer of translucent white ink upon which a second ink film image is carried in registry with the first image.

Turning now to FIG. 6, another embodiment of the method of the present invention is illustrated wherein the desired image is created by a first ink film generally designated 102 which is applied to the front surface 104 of a substrate generally designated 106. The layer of ink film 102 and substrate surface is overpainted with a translucent white paint layer generally designated 108. A second ink film generally designated 110 is applied to the surface 112 of the translucent white ink or paint layer 108 and in registry with the first ink film layer 102. The substrate 106 preferably is transparent having a 100% transmission factor while the layer of translucent white paint or transparent semi-reflective material 108 has a 15% transmission factor. In this embodiment it can be seen from FIG. 6 that light emitted from a light source placed in front of the image passes through the ink film layer 110 and is reflected by the surface 112 of the white ink layer 108 back through the film 110 thereby passing through the ink film twice which is the equivalent of two ink thicknesses. Likewise, it can be seen that a light source placed in back of the substrate 106 emits light which passes through the substrate 106 and through the film 102, through the white ink layer 108 and through the ink film 110. Accordingly, a viewer observing the image receives light which has substantially the same spectral content whether the image is illuminated by front light or a back light since the emitted light passes through two thicknesses of ink film in both instances. One benefit of this embodiment is that only one substrate is required thus reducing costs of a final colored graphic that is to be viewed under both front and back lighting conditions.

Again as described above, compensation may be made to correct for imperfect pigmented inks and light sources having different spectral content (such as sunlight and fluorescent lamps) to adjust the density and color balance achieved with front and back lighting.

A method for producing an image with a four color process ink on a substrate surface wherein the image exhibits substantially the same spectral content when illuminated by a light source located in front of the surface carrying the image as when illuminated by a light source located behind the surface carrying the image has been disclosed above in several preferred embodiments. It will be understood that additional changes and embodiments may be made by those skilled in the art without departing from the spirit and scope of the present invention. Therefore, the invention has been described by way of illustration rather than limitation.

We claim:

1. Method for obtaining substantially an equivalent spectral content from an ink film carried on a surface when illuminated by a light source located in front of the surface carrying the ink film as when illuminated by a light source located behind the surface carrying the ink film, said method comprising the steps of:

applying a first ink film in a predetermined thickness on a first surface in a predetermined location, applying a second ink film in a predetermined thickness on a second surface in a predetermined location;

said first and second ink films being in registry;

passing light through said first ink film thickness twice from a light source located on the same side as said first surface and passing light through said second ink film and said first ink film from a light source located on the opposite side of said first surface whereby light passes through two film thicknesses such that a viewer observing said first ink film on the same side as said first ink film observes light having the same spectral content as light passing through said second ink film and said first ink film from a light source located on the side opposite said first ink film and the viewer.

2. Method as defined in claim 1 wherein the steps of applying first and second ink films further include the steps of applying said first ink film on a first surface of a first substrate and applying said second ink film on a surface of a second substrate.

3. Method as defined in claim 1 wherein the steps of applying first and second ink films further include the steps of applying said first ink film on a first surface of a first substrate and applying said second ink film on a second surface of said first substrate and oppositely disposed from said first surface.

4. Method as defined in claim 3 wherein the steps of applying said first and second ink films further include applying said first and second ink films to said first and second surfaces respectively of a translucent substrate.

5. Method for producing an image using four color process inks on a substrate wherein a viewer observes the image with substantially an equivalent spectral content when the image is illuminated by backlight or frontlight, said method comprising the steps of:

providing at least one sheet-like substrate having front and rear surfaces for receiving or not receiving a least one colored ink in predetermined amounts in registry to produce a resultant desired color forming said image;

depositing at least one colored ink in a predetermined film thickness at a predetermined location on the front surface to form said image;

depositing at least one colored ink in predetermined film thickness at a predetermined location on the rear surface, said ink and predetermined location on said rear surface being in registry with said ink and said predetermined location on said front surface, said image formed on said front surface being the mirror image of said image formed on said rear surface whereby light passes through two ink film thicknesses such that a viewer observing said image formed on the front surface when the image is illuminated by frontlight observes light having the equivalent spectral content when light passes through the image formed on the front surface and through the image formed on the rear surface when the image is illuminated by backlight.

6. Method for producing an image as defined in claim 5 wherein said step of providing a sheet like substrate includes providing a translucent substrate.

7. Method for producing an image as defined in claim 5 wherein said step of providing a sheet like substrate includes providing a translucent substrate made of a vinyl material.

8. Method for producing an image having desired colors with four color process inks on a surface whereby the image exhibits substantially an equivalent spectral content when illuminated by a light source located in front of the surface carrying the image as when illuminated by a light source located behind the surface carrying the image, said method comprising the steps of:

providing at least one sheet of a material having a front and rear surface for receiving on at least one of said front and rear surfaces, the colored inks at predetermined locations on the sheet surface and in a predetermined overlapping manner to generate a first image having desired colors on the sheet material surface;

producing a first image having the desired colors by providing a first ink film thickness on a first surface;

producing a second image substantially identical to said first image and having the desired colors by providing a second ink film thickness on a second surface, and said first and second ink films being in registry whereby light passes through two film thicknesses such that a viewer observing said image on the same side as said first ink film when the image is illuminated by light source in front of the surface carrying the first image observes light having the equivalent spectral content as light passing through said second ink film and said first ink film from a light source located behind the surface carrying the second image.

9. Method for producing an image as defined in claim 8 further including the step of producing said first surface by overpainting said second ink film on said second surface with a white translucent ink film layer.

10. Method for producing an image as defined in claim 9 further including the step of illuminating said first ink film by locating a light source on the same side as said sheet material rear surface whereby light passes through said sheet material and said second ink film, through said white translucent ink layer and through said first ink film so that light reaching an observer passes through two ink film thicknesses.

11. Method for producing an image as defined in claim 9 further including the step of illuminating said first ink film by locating a light source on the same side as said sheet material front surface whereby light passes through said first ink film in one direction toward said white translucent ink layer, and reflecting light impinging on said white translucent ink layer back through said first ink film in a direction substantially opposite to the one direction so that light reaching an observer passes through two ink film thicknesses.

* * * * *